US009079203B2

(12) United States Patent
Cheng

(10) Patent No.: US 9,079,203 B2
(45) Date of Patent: Jul. 14, 2015

(54) METHOD AND APPARATUS FOR BALANCING FLOW THROUGH FUEL NOZZLES

(75) Inventor: Dah Yu Cheng, Los Altos Hills, CA (US)

(73) Assignee: Cheng Power Systems, Inc., Mountain View, CA (US)

( * ) Notice: Subject to any disclaimer, the term of this patent is extended or adjusted under 35 U.S.C. 154(b) by 1425 days.

(21) Appl. No.: 11/818,672

(22) Filed: Jun. 15, 2007

(65) Prior Publication Data

US 2008/0308653 A1 Dec. 18, 2008

(51) Int. Cl.

| | |
|---|---|
| ***B05B 1/34*** | (2006.01) |
| ***F02M 61/16*** | (2006.01) |
| ***F23D 1/00*** | (2006.01) |
| ***F23D 11/38*** | (2006.01) |
| ***F23D 14/48*** | (2006.01) |
| ***F23D 14/84*** | (2006.01) |

(52) U.S. Cl.

CPC ..... *B05B 1/3415* (2013.01); *B05B 1/341* (2013.01); *B05B 1/3405* (2013.01); *F02M 61/162* (2013.01); *F23D 1/00* (2013.01); *F23D 11/383* (2013.01); *F23D 14/48* (2013.01); *F23D 14/84* (2013.01); *F23D 2203/1012* (2013.01); *F23D 2210/00* (2013.01)

(58) Field of Classification Search

CPC ..... B05B 1/34; B05B 1/3405; B05B 1/341; B05B 1/3415; F02M 61/162

USPC ..... 239/5, 463, 474, 475, 487, 488, 489, 239/505, 518, 533.2; 60/744, 748

See application file for complete search history.

(56) References Cited

U.S. PATENT DOCUMENTS

| | | | | |
|---|---|---|---|---|
| 1,974,110 | A * | 9/1934 | Higley | 138/39 |
| 4,763,482 | A | 8/1988 | Wehner | |
| 5,193,346 | A | 3/1993 | Kuwata et al. | |
| 5,197,509 | A | 3/1993 | Cheng | |
| 5,295,352 | A | 3/1994 | Beebe et al. | |
| 5,323,661 | A | 6/1994 | Cheng | |
| 5,529,084 | A * | 6/1996 | Mutsakis et al. | 137/13 |
| 5,579,645 | A | 12/1996 | Prociw et al. | |
| 5,988,531 | A * | 11/1999 | Maden et al. | 239/406 |
| 6,082,113 | A | 7/2000 | Prociw et al. | |
| 6,141,968 | A | 11/2000 | Gates et al. | |
| 6,286,302 | B1 | 9/2001 | Farmer et al. | |
| 6,289,676 | B1 | 9/2001 | Prociw et al. | |
| 6,289,677 | B1 | 9/2001 | Prociw et al. | |
| 6,363,726 | B1 | 4/2002 | Durbin et al. | |
| 6,389,815 | B1 | 5/2002 | Hura et al. | |
| 6,457,316 | B1 | 10/2002 | Czachor et al. | |
| 6,708,498 | B2 | 3/2004 | Stickles et al. | |
| 6,755,024 | B1 * | 6/2004 | Mao et al. | 60/776 |
| 6,820,411 | B2 * | 11/2004 | Pederson et al. | 60/229 |
| 6,820,431 | B2 | 11/2004 | McManus et al. | |
| 6,871,488 | B2 | 3/2005 | Oskooei et al. | |
| 6,886,342 | B2 | 5/2005 | Alkabie | |
| 6,898,938 | B2 | 5/2005 | Mancini et al. | |
| 7,062,919 | B2 | 6/2006 | Alkabie | |
| 7,104,069 | B2 | 9/2006 | Martling et al. | |
| 7,104,070 | B2 * | 9/2006 | Iasillo et al. | 60/775 |
| 7,137,258 | B2 | 11/2006 | Widener | |

(Continued)

*Primary Examiner* — Ryan Reis

(57) ABSTRACT

A fuel nozzle having a flow pathway including a smooth, sharp, or mitered bend prior to a nozzle tip is provided. The fuel nozzle injects fuel into a combustion chamber with an even flow distribution of the fuel and substantially reduces undesirable acoustic resonance encountered in a fuel nozzle body in a combustion system.

22 Claims, 5 Drawing Sheets

(56) References Cited

U.S. PATENT DOCUMENTS 7,171,813 B2 2/2007 Tanaka et al.
7,174,717 B2 2/2007 Prociw
2007/0012042 A1 1/2007 Alkabie et al.

* cited by examiner

METHOD AND APPARATUS FOR BALANCING FLOW THROUGH FUEL NOZZLES

TECHNICAL FIELD

The disclosure herein relates to fuel nozzles, and more particularly use of a rotation element in a fuel nozzle for balancing flow distribution of gaseous or liquid fuels from nozzle ejection holes.

BACKGROUND

Combustion systems using fuels in gaseous or liquid form typically feed such fuels into a burner through a fuel nozzle. Such fuel nozzles generally have a sharp bend towards the end of the fuel nozzle flow pathway. Conventional fuel nozzles typically have an uneven fuel flow distribution which is caused by a higher centrifugal force near the inner radius of the bend than near the outer radius. Greater fuel flow is experienced near the outer radius of the bend in the form of increased stagnation pressure. As a result, the flame extending from the fuel nozzle tip becomes asymmetrical.

The undesirable effects of uneven flow distribution can be seen in combustion systems employing conventional fuel nozzles containing sharp bends. For example, in gas turbine fuel burners the combustion liner on an inner surface tends to be over-heated at the fuel rich part of the combustion chamber, thereby shortening a life span of parts therein. Another example can be observed in coal-fired boilers where pulverized coal particles are carried by air. The uneven distribution of pulverized coal powder in the burner section creates an oxygen-rich region and an oxygen starved region in the produced flame. The presence of such regions causes combustion deficiencies in terms of black smoke and/or undesirable CO concentrations as well as accelerates wear of parts.

Conventional nozzle designs for use in combustion systems are described in U.S. Pat. Nos. 7,174,717, 7,171,813, 7,104,069, and 7,104,070 which are incorporated herein by reference as part of this background discussion.

There is a need for a satisfactory solution to the problem of uneven flow distribution.

Commonly owned U.S. Pat. Nos. 5,323,661 and 5,529,084 (each of which is incorporated herein by reference) describes rotation vane devices for performing a rotational transformation in a fluid flow similar to the principle of rotational transformation in a magnetic confinement system of plasmas, and explains an approach for determining a curvature of turning vanes in said rotation vane device in order to minimize turbulence experienced by a fluid moving through a smooth pipe bend.

The approach of U.S. Pat. Nos. 5,323,661 and 5,529,084 does not address, however, the issue of uneven fuel flow being injected into a combustion chamber from a fuel nozzle comprising a sharp or mitered bend.

In addition the above mentioned fuel nozzles do not provide a solution to the problems of low frequency acoustic resonance encountered at subsonic flow conditions in combustion systems.

BRIEF SUMMARY

This disclosure provides an improved rotation element that can be utilized in a fuel nozzle to correct fuel flow imbalance when fuel flows through a fuel nozzle comprising a sharp bend prior to injection of said fuel into a combustion chamber. In a preferred embodiment, a rotational element is placed within the pathway of the fuel flow, prior to a bend upstream of the nozzle tip. The rotation element includes turning vanes configured to transform uneven fuel flow into a balanced distribution.

In addition, the collection of rotation vanes acts as a soft check valve in the rotation element in the flow pathway. The soft check valve described herein provides less pressure resistance in the forward flow direction of the flow pathway than in the reverse flow direction. Such a feature is advantageous, particularly when the fluid is gaseous, because the soft check valve changes the acoustic characteristics of the nozzle body and reduces undesirable resonance which is often encountered in combustion systems at low subsonic flow conditions.

BRIEF DESCRIPTION OF THE DRAWINGS

The features of the subject matter of this disclosure can be more readily understood from the following detailed description with reference to the accompanying drawings wherein.

DETAILED DESCRIPTION OF THE PREFERRED EMBODIMENTS

Figure 1:
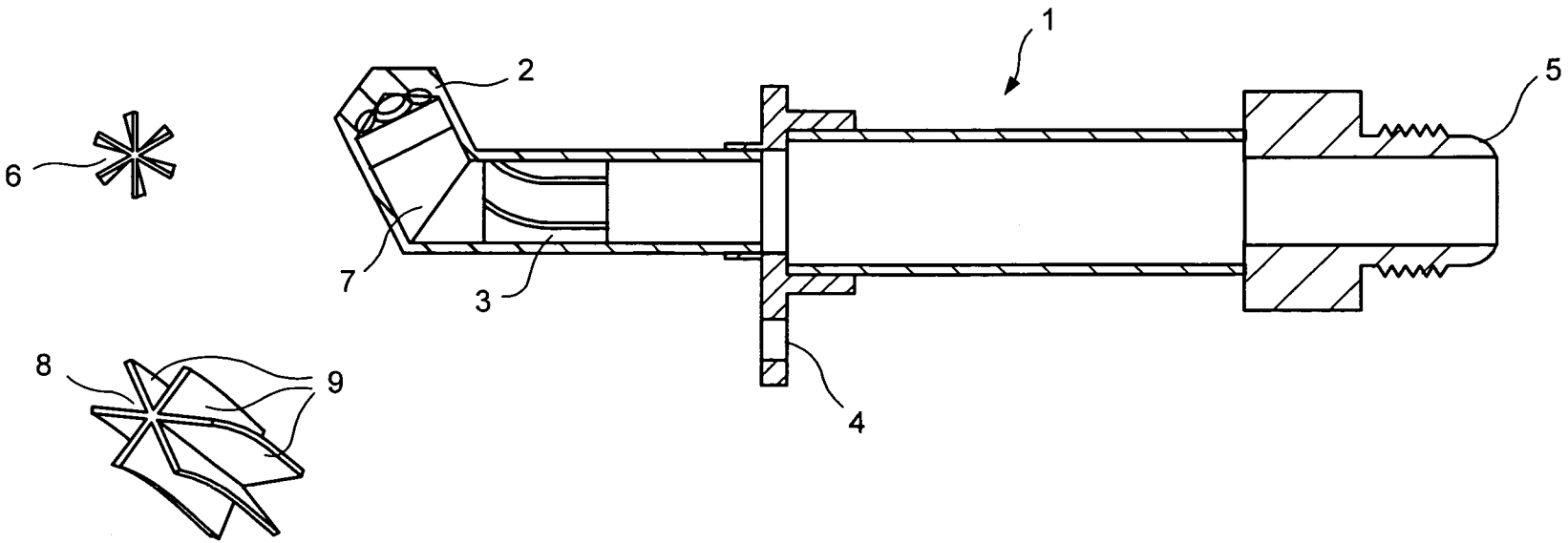
FIG. 1 illustrates a schematic view of a preferred embodiment of a new nozzle design.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. In addition, a detailed description of known functions and configurations will be omitted when it may obscure the subject matter of the present invention.

Some exemplary embodiments of this disclosure are described infra wherein a fuel nozzle is configured to generate a balanced distribution of fuel flow or flow of a mixture of fuel and a diluent exiting a nozzle tip. In particular, a rotation element is inserted in a flow pathway upstream of a sharp bend in said pathway, where said sharp bend may have an angle (or change of direction of said pathway) in a range of slightly above 0 to 180 degrees. The rotation element includes rotation or turning vanes configured to redirect uneven flow into the above-mentioned balanced distribution. Such rotation vanes in the rotation element can also change the acoustic characteristics of a classic nozzle design. The term "classic nozzle design" as used herein refers to a fuel nozzle comprising a flow pathway including a first portion followed by a smooth or sharp bend in said flow pathway, followed by another section leading to a nozzle tip with ejection holes for fuel injection into a combustion chamber.

The term "smooth bend" as used herein refers to a turn in the flow pathway wherein the cross-sectional area of the pathway is maintained throughout the bend without any cusps or corners in the boundary walls of the flow pathway. On the other hand, a "sharp bend" refers to one or more abrupt changes in the smoothness of the boundary walls of a cylindrical flow pathway wherein such a bend includes one or more cusps or corners such as in the case of a mitered bend.

FIG. 1 illustrates a fuel nozzle in accordance with a preferred embodiment of this disclosure. The fuel nozzle 1 can be used in combustion systems (for example, in gas turbines or burner tips for boilers) and further comprises a rotational element 3 within a flow pathway placed prior to a sharp bend 7 in the fuel nozzle 1. The nozzle tip 2 has multiple holes so that the fuel flowing through the fuel nozzle 1 can be ejected into a combustion chamber (not illustrated). An illustration of the rotational element 3 from an axial view 6 is included in FIG. 1. A three dimensional angled illustration 8 of the rotational element 3 is also included. It is seen that the three dimensional angled illustration 8 of the rotational element 3 in this embodiment has a leading edge geometry with a zero angle of attack with respect to the on-coming fuel or fluid flow, followed by a first portion wherein fluid enters the rotational element. As seen in the angled illustration 8 of the rotational element 3 the remainder of the rotational element 3 encompasses a plurality of turning vanes 9 each with curvature that rotates the fluid along an axis parallel to that of the nozzle body so that preferably fluid exits the rotational element 3 with a designated angle in order to substantially cancel the uneven centrifugal flow caused by the sharp bend 7. In this embodiment the sharp bend 7 in the fuel nozzle 1 is immediately after rotation vane 3 and leads to nozzle tip 2. The fuel nozzle 1 in this embodiment further comprises a mounting flange 4 and an entrance connection 5.

The principle used in guiding the curvature of the turning vanes of a preferred embodiment of the rotation element disclosed herein can be described in terms of a mathematical formula known in fluid mechanics as curl X curl X V=0, wherein "V" represents a velocity vector field and curl X curl X V is equivalently curl(curl(V)) or in alternative notation del x del x V. This mathematical formula applies to fluid mechanics only and therefore provides a better and more realistic guide for the curvature of the turning vanes encompassed by a preferred rotational element, as opposed to that in prior art incorporated herein by reference wherein rotational elements are guided by solutions to rotational transformation in a magnetic confinement system of plasmas.

In furtherance, when fluid is being turned by a curved pipe or sharp bend, the action is describable by the mathematical formula curl X V. A preferred embodiment of the disclosure herein places a rotational vane element upstream of the curl X V action within a fluid flow field and conforms to the formula curl X curl X V=0 through means of a set of turning vanes. The action of curl X V by the bend in the fuel nozzle body is fixed by the geometry of that bend. With this information as a given constant in a particular fuel nozzle, a second Curl can be determined by the formula curl X curl X V=0 to conform a rotational element with turning vanes to have a curvature and a minimum turning angle along the axis of the fluid conduit satisfying this mathematical formula. In such a configuration, the action of a bend in a fuel nozzle described as a Curl function creating centrifugal forces is substantially cancelled. As a result of this cancellation, it is shown that such a configuration produces an even fluid flow distribution exiting such a nozzle and furthermore works independent of the magnitude of the fluid flow velocity.

In a preferred embodiment of this disclosure and as previously stated the relationship of the turning vane turning angle and a fuel nozzle bend is describable as curl×curl X V=0. Herein, as previously stated, the symbol "V" stands for the velocity vector field of a fluid flowing through an embodiment of a fuel nozzle disclosed herein. The rotation vane turning angle can be greater than the minimum required condition described by curl X curl X V=0, but should not be less. A reduction in the turning vane angle below this required condition would reduce the effectiveness of the embodied fuel nozzle in balancing a fuel flow distribution and in changing the acoustic characteristics of the nozzle body. However, increasing the turning angle beyond the minimum required condition described is preferable although the result is a slight increase in the pressure drop of fuel flow through a nozzle. However, with an increased turning angle on the rotation element resistance to the reverse flow will dramatically increase resistance (relative to the increase in pressure drop) during subsonic flow conditions.

Figure 2A:
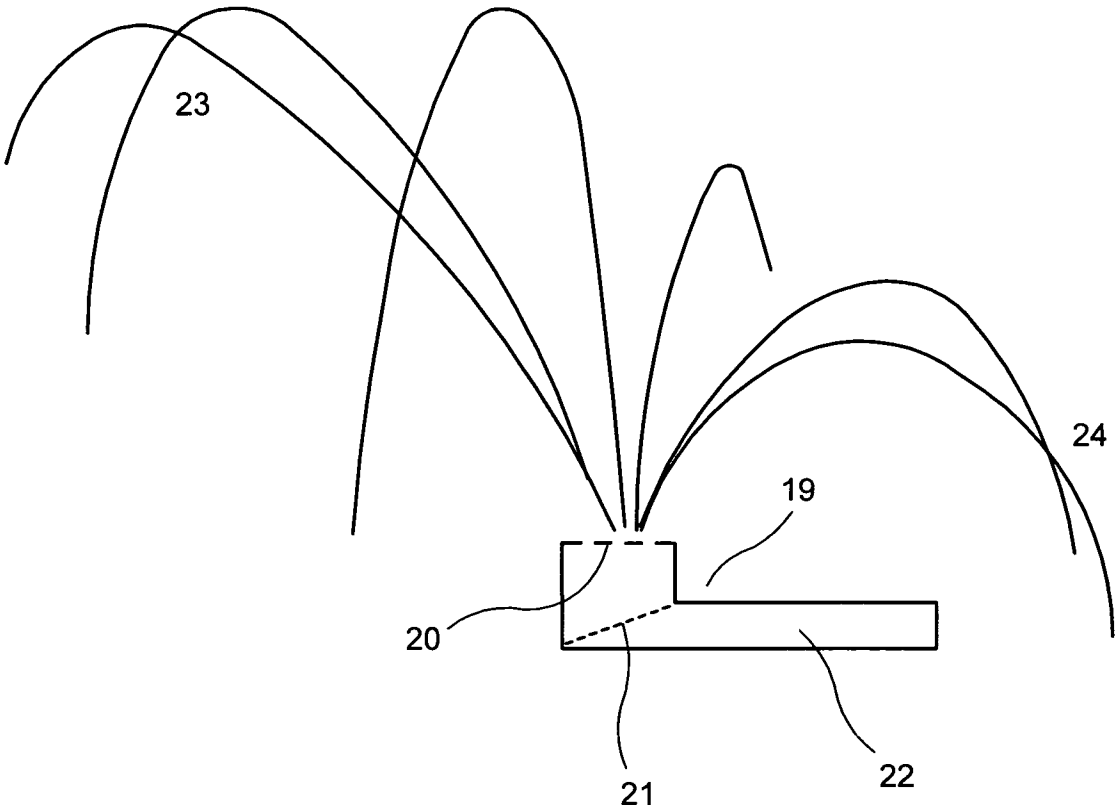
FIG. 2*a* illustrates fluid flow exiting a conventional fuel nozzle.
Figure 2B:
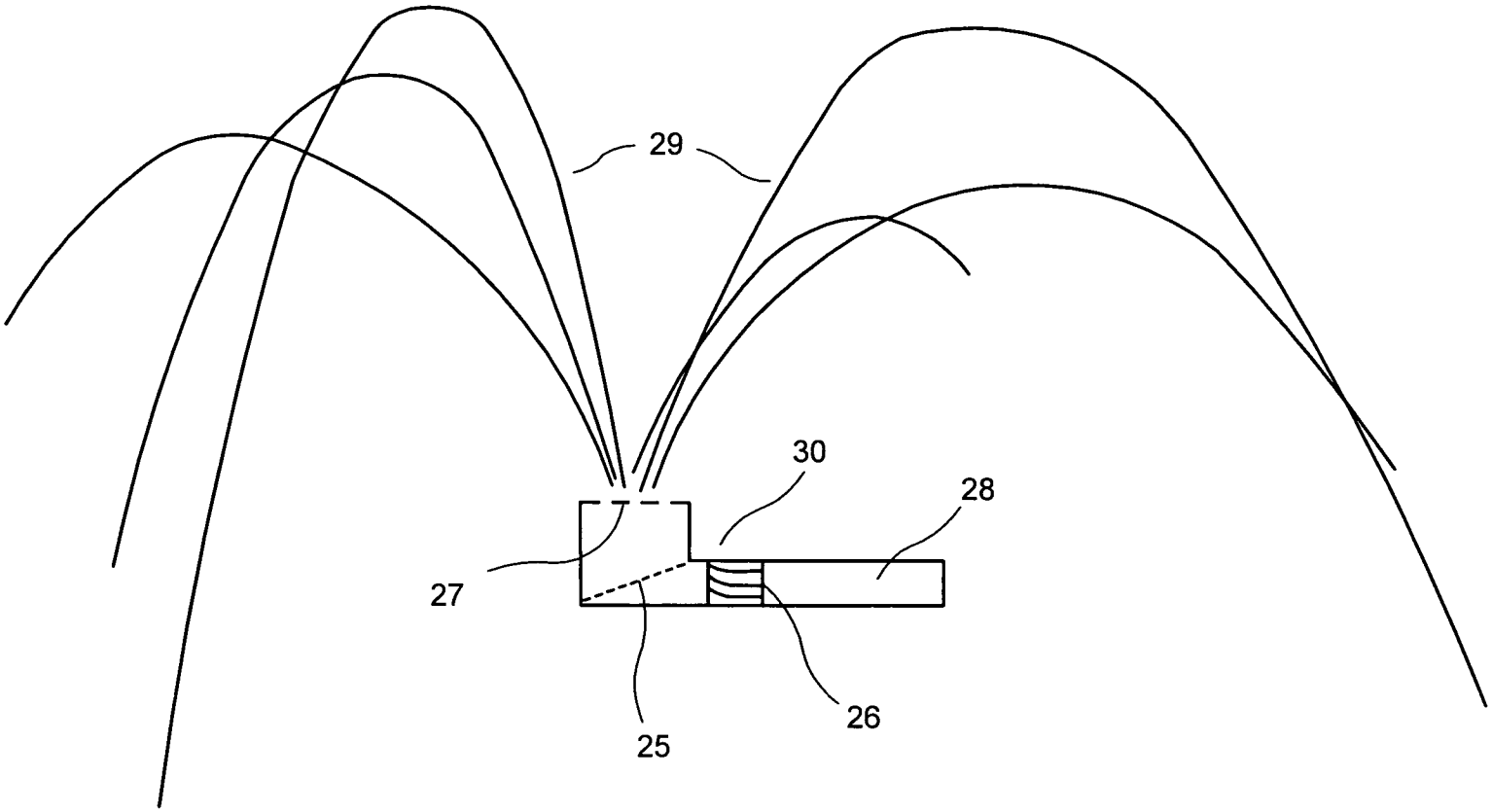
FIG. 2*b* illustrates an example of fluid flow exiting a fuel nozzle according to an exemplary embodiment of this disclosure.

FIGS. 2*a* and 2*b* are illustrations of experimental demonstrations using water to illustrate fuel flow exiting two different fuel nozzles. The illustrated demonstrations of flow distribution use pressurized liquid and are depicted accordingly. FIG. 2*a* is an illustration of experimentally observed fluid flow distribution exiting a classic fuel nozzle 19 encompassing a first section 22, a mitered bend 21 in the fluid flow pathway (mitered bend depicted by a dashed line), and a nozzle tip 20 with holes for ejection of fluid. It is experimentally observed and shown in the illustration that there is 30% more fluid flow 23 in the same direction as the direction of flow in first section 22 of the fluid flow pathway as opposed to the fluid flow in the opposite direction 24.

FIG. 2*b* is an illustration of experimentally observed fluid flow distribution exiting an embodiment of a fuel nozzle 30 disclosed herein comprising a mitered bend 25 in the fluid flow pathway (mitered bend depicted by a dashed line), a first section 28 of fluid flow pathway, a rotation vane 26 prior to said bend, and a nozzle tip 27 with holes for the ejection of fluid. Observed and illustrated in FIG. 2*b* is an even fluid flow distribution 29 exiting the embodied fuel nozzle 30.

Figure 3A:
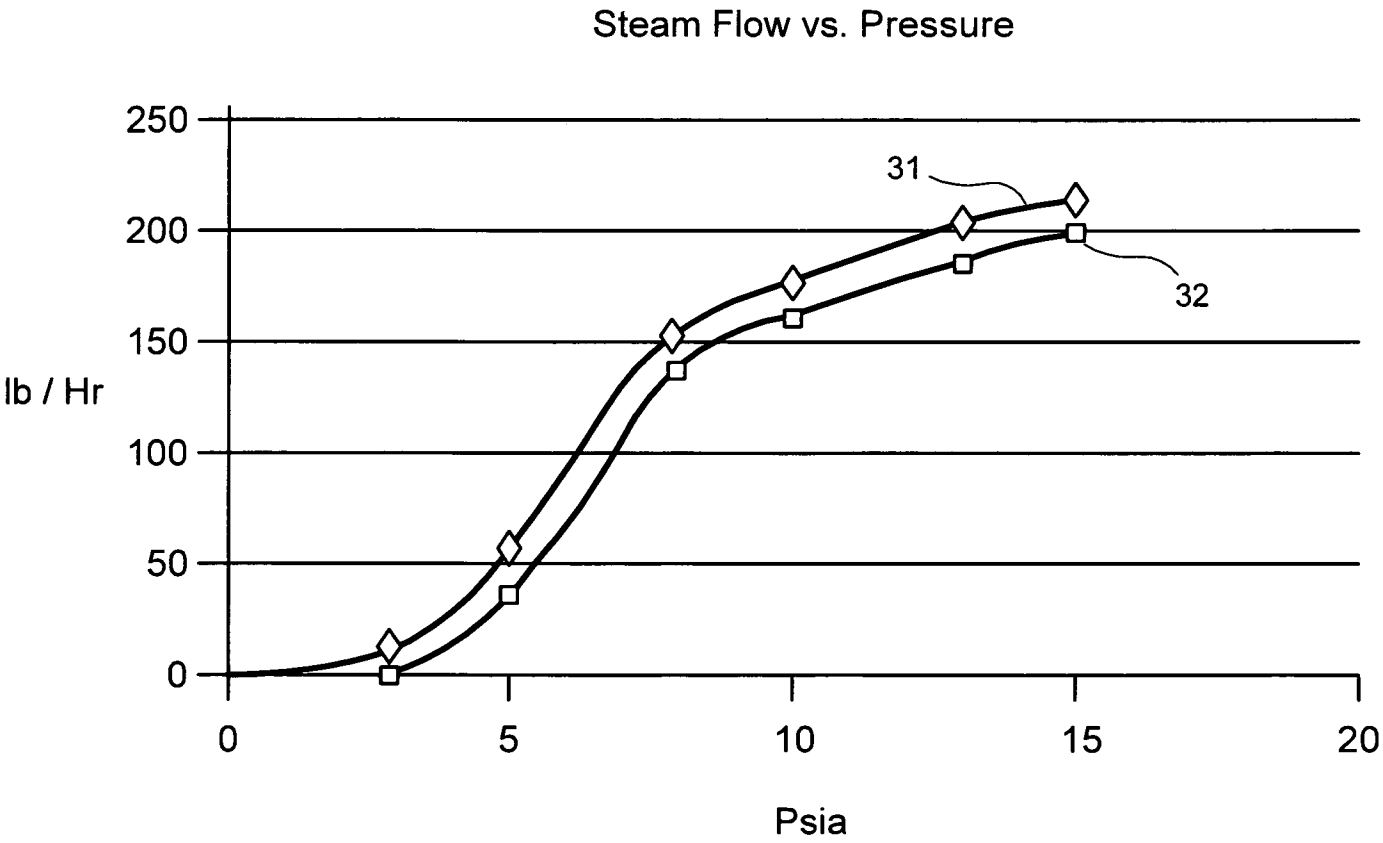
FIG. 3*a* shows a plot of steam flow versus pressure in two different nozzle designs in the forward flow direction.
Figure 3B:
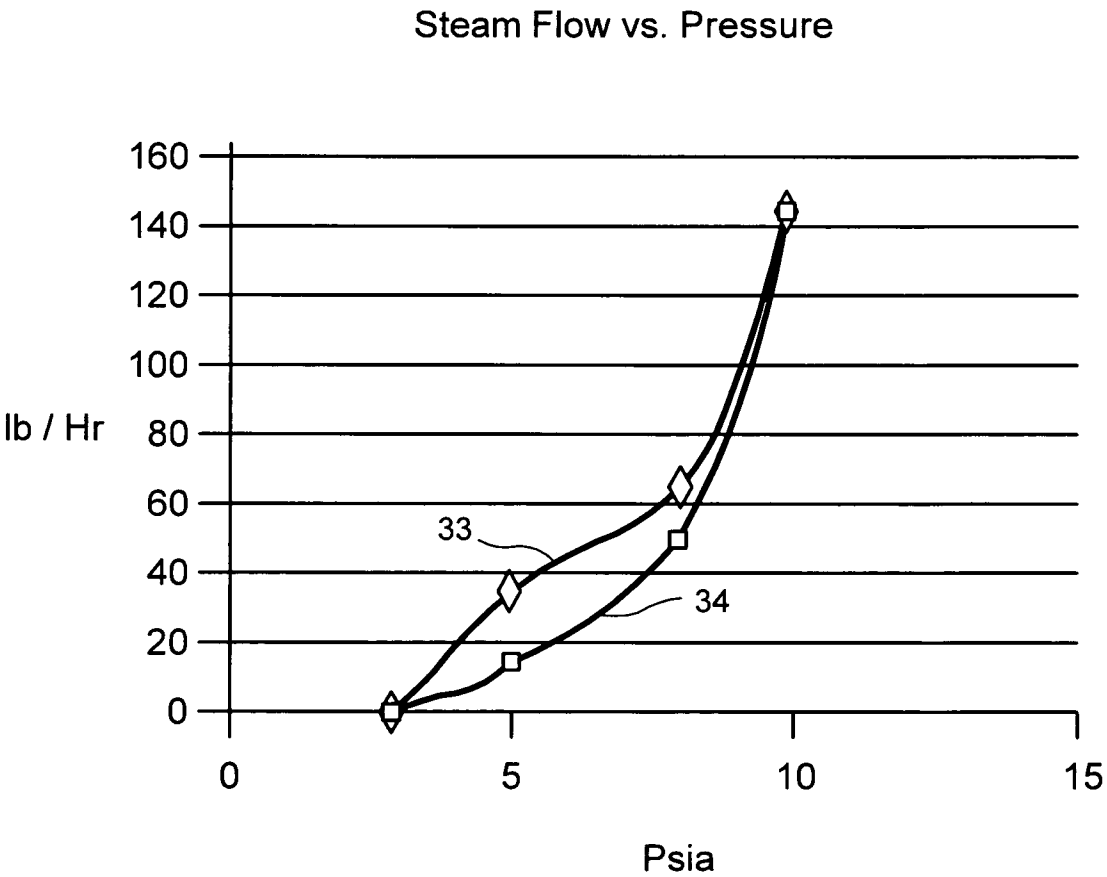
FIG. 3*b* shows a plot of steam flow versus pressure in two different nozzle designs in the reverse flow direction.

FIGS. 3*a* and 3*b* are graphical drawings of experimental data of fuel flow characteristics collected respectively from an embodiment of the fuel nozzle disclosed herein comprising a sharp bend and a rotational vane, and a classic fuel nozzle design comprising an identical sharp bend but no rotational vane. FIG. 3*a* is a plot of steam flow (lb/Hr) vs. pressure (Psia) collected using steam as an example of a "gaseous fuel". Data collected from a classic fuel nozzle design 31 illustrates a pressure drop vs. fuel compared to data collected from an embodiment of the fuel nozzle disclosed herein 32. On the high differential pressure side, the flow is choked. The data collected from an embodiment of the fuel nozzle disclosed herein 32 requires a slightly higher pressure for similar flow.

In FIG. 3*b*, the flow is being tested in the reverse direction. The curve 33 represents data collected from a classic fuel nozzle design. The curve 34 represents data collected from an embodiment of the fuel nozzle disclosed herein. Around 5 psi it is shown in FIG. 3*b* that in the reverse direction the embodiment of the fuel nozzle disclosed herein has a higher resistance to reverse flow than the classic nozzle design.

FIGS. 3*a* and 3*b* illustrate that an embodiment of the fuel nozzle disclosed herein comprising the addition of a rotational vane allows a rotational vane to act as a soft check valve that provides little resistance in the forward flow direction and a much higher resistance in the reverse flow direction.

In a preferred embodiment of this disclosure a soft check valve feature can provide resistance to propagation of pressure pulsation from a combustion chamber through fuel nozzle holes backwards into a nozzle body. At low flow conditions, such a phenomenon causes a resonance of acoustic pressure in a nozzle body. This is typically exhibited and observed as a low frequency rumbling noise. With a soft check valve, such as a rotational vane described herein, the resonance chamber length of the nozzle body can be reduced to the region slightly beyond the band of a nozzle tip. This change in resonance chamber length substantially reduces the acoustic resonance characteristic length in a nozzle body. This reduction of resonant characteristic length increases the frequency at which the required resonance must occur, thereby reducing occurrences of undesirable acoustic pressure resonance.

The resonance described herein is a coupling between the acoustic pressure pulse in the combustion chamber and the nozzle fuel flow. Low frequency resonance contains higher pressure amplitude which modulates the flow velocity of a fuel nozzle. High frequency resonance usually has a much lower pressure wave in amplitude, which is less effective at modulating the fluid flow combustion. The most desirable design configuration for a fuel nozzle would be one that encompasses a reduction or substantial elimination of low frequency coupling.

As mentioned above, an improved design for fuel nozzles for gas turbines and boilers to improve fuel flow characteristics of fuel exiting a nozzle tip preferably serves two functions: balances the fuel flow distribution exiting a nozzle tip and changes the acoustic characteristics of a nozzle body.

The guideline of curl X curl X V=0 describes a preferred embodiment of a fuel nozzle disclosed herein that is different from the prior art as designed, wherein said prior art served to reduce turbulence in a smooth pipe bend using a rotation vane element guided by a different minimum turning angle formulation. Prior art fuel nozzle designs cannot sufficiently solve the problems of uneven fuel flow distribution exiting a nozzle tip nor change the acoustic characteristics of a nozzle body when a pipe or flow pathway of fuel has a much sharper turn (for example, a mitered turn). The guideline of a curl×curl X V=0 relationship causes pressure distribution reaching nozzle tip holes to be as uniform as possible; even the breakup of certain streamlines around a bend is allowable unlike prior art designs guided by a magnetic flux analogy used in plasma confinement. Therefore, the turning angle produced by a rotation vane should be equal to or greater than minimum requirements as defined by a curl X curl X V=0 relationship.

As previously described, the turning of a pipe (such as a bend of a pipe or flow pathway) imposes a Curl function over the velocity vector field V of a fluid. Furthermore, a second Curl function can impose a cancellation of this effect through means of a rotation vane. Therefore, a rotation vane turning angle and a bend of a fuel nozzle body can be related to each other and a satisfactory solution to curl X curl X V=0 can be obtained by forming the curvature of the turning vanes in a rotational element to create the minimum necessary turning angle.

In combustion phenomena, when fuel flow is at a low subsonic level, pressure resonance due to combustion waves in a combustion chamber can be fed back through a nozzle tip as pressure pulses in the gaseous fuel. At low subsonic flow conditions or typically low pressure differential flow conditions, a pressure pulse can trigger a resonance of pressure waves in a nozzle body. When coupled with a pressure wave in the combustion chamber, a low frequency rumbling sound is typically produced. Amplification of such a wave creates undesirable effects to a combustion apparatus and it is desirable to remove this resonance as much as possible.

To accomplish the removal of undesirable resonance in a fuel nozzle for use in a combustion system, the equation curl X curl X V=0 is used as a design guideline to determine the minimum turning angle that maximizes even fuel flow distribution. An increase from this minimum turning angle of the rotation vanes provides a residual rotation to the fuel flow beyond the bend or elbow in a fuel nozzle or flow pathway but does not effect the pressure distribution across the diameter of the nozzle tip. This added effect can provide another guideline for the design of a rotation vane the implementation of which can typically remove as much as possible the undesirable low frequency combustion rumbling previously described.

In a preferred embodiment, the configuration of a fuel nozzle disclosed herein encompasses a rotation element welded in place so as not to alter the outer configuration of a nozzle design in which a rotation element is inserted. This makes the fuel nozzle disclosed herein an acceptable retrofittable replacement for current fuel nozzles in the fields of gas turbines and boilers or alternatively current fuel nozzles can be altered to meet the configuration of the disclosure herein.

Embodiments of the fuel nozzle configuration enclosed herein have real world applications and experimentally have been shown to be applicable to current combustion systems. For example, the illustrated nozzle design of FIG. 1 can be applied to the GE LM series of turbines. The rotational element 3 in FIG. 1 can be located farther away from the bend then is illustrated in FIG. 1, in fact, placement of a rotation vane as far away as the entrance of the fuel nozzle is acceptable. Such an arrangement has been tested on a Rolls Royce Avon turbine where 4 turning vanes were used in a rotational element because of the smoother bend of the Rolls Royce Avon turbine fuel nozzle. Other nozzle configurations consistent with this disclosure may have different bend geometry and in such configurations when more extreme or mitered bends are present a minimum of 6 turning vanes is necessary and optimal for the successful operation of the disclosure herein. Further experiments using designs of the disclosure herein have been tested on pulverized coal nozzles in a fired boiler. The pulverized coal was carried by high velocity air flow and the results showed a very uniform combustion flow in the combustion chamber, in agreement with the intended design of the chamber, as well as an increase in part lifespan in the combustion system.

The specific embodiments and examples described above are illustrative, and many variations can be introduced on these embodiments without departing from the spirit of the disclosure or from the scope of the appended claims. For example, elements and/or features of different examples and illustrative embodiments may be combined with each other and/or substituted for each other within the scope of this disclosure and appended claims.

What is claimed is:

1. A fuel nozzle for injection of fuel into a combustion chamber, said fuel nozzle comprising:

a fuel flow pathway including a first section and a sharp bend having one or more abrupt changes in the smoothness of boundary walls, said sharp bend being downstream of said first section; and a flow rotation element within said flow pathway, upstream of said sharp bend;

said rotation element comprising a plurality of turning vanes, said turning vanes being configured with a curvature to redirect fuel flow to produce a substantially uniform distribution of said fuel flow when said fuel flows through and is redirected by said sharp bend, said redirected flow exiting said fuel nozzle;

wherein said curvature of said turning vanes is configured to produce a rotation of said fuel flow having a turning angle upon exit of said rotational element satisfying the following condition where V represents a velocity vector field of said fuel flowing through and exiting said fuel nozzle: curl x curl x V≥0.

2. The fuel nozzle of claim 1, wherein said turning angle represents a difference in direction of flow of said fuel as between the fuel immediately prior to entering the rotation element and the fuel immediately after exiting the rotation element.

3. The fuel nozzle of claim 1, wherein said curvature is selected to obtain a reduced pressure drop of fuel exiting said nozzle tip in subsonic flow conditions, relative to another rotation element with rotation vanes having a second curvature satisfying curl x curl x V≥0.

4. The fuel nozzle of claim 1, wherein said first section is substantially straight and said turning vanes are fixed and preferably symmetrically distributed about a central axis of said rotation element parallel to a direction of flow through said first section of the flow pathway.

5. The fuel nozzle of claim 1 further comprising:

a nozzle tip for injection of said substantially uniform flow distribution of fuel into said combustion chamber.

6. The fuel nozzle of claim 5, wherein said nozzle tip comprises a fuel nozzle tip coupled to an end of said flow pathway and said nozzle tip is configured to inject fuel into a combustion chamber.

7. The fuel nozzle of claim 1, further comprising a mounting flange coupled to an entrance of said flow pathway.

8. The fuel nozzle of claim 7, further comprising an entrance connection coupled to said mounting flange and configured for tight coupling with a fuel delivery channel.

9. The fuel nozzle of claim 1, wherein said rotation element includes at least four turning vanes.

10. A rotation element for use in a fuel nozzle having a flow pathway and a bend in said flow pathway, said rotation element comprising:

rotation vanes located upstream of said bend and configured to impart rotation to a flow of fuel through said flow pathway to produce a substantially uniform distribution of said fuel flow after the fuel flows through and is redirected by said bend in said fuel nozzle;

said rotation vanes being further configured to provide relatively low pressure resistance to a forward flow of said fuel through said vanes and a relatively high pressure resistance to a reverse flow of said fuel through said vanes; wherein each of said vanes has a curvature selected according to a geometry of a body of the nozzle and is configured to change a direction of flow of said fuel with a turning angle that satisfies the following condition where V represents a velocity vector field of said fuel: curl x curl x V≥0;

and said rotation vanes being further configured to provide acoustic damping removing undesirable acoustic resonance in a body of said fuel nozzle.

11. The rotation element of claim 10, wherein said fuel is gaseous.

12. The rotation element of claim 10, wherein the rotation element is configured to be placed in a fuel nozzle having a cylindrical flow pathway.

13. The rotation element of claim 10, wherein said flow pathway of said fuel nozzle includes a first section coupled to an entrance of said flow pathway, and wherein said rotation vanes comprise a plurality of turning vanes symmetrically placed about a central axis parallel to said first section of said fuel nozzle.

14. The rotation element of claim 13, wherein said turning vanes are configured to rotate said fuel along an axis of said fuel nozzle so that said fuel exits said rotation element with a desired turning angle.

15. The rotation element of claim 13 wherein said first section is substantially straight and each of said turning vanes comprises a leading edge with a zero angle of attack with respect to oncoming fuel followed by a first portion where said fuel enters the rotational element.

16. The rotation element of claim 13, wherein said plurality of turning vanes includes at least four turning vanes.

17. A method for producing balanced flow of a fuel nozzle, said method comprising:

flowing said fuel through a flow pathway including a substantially straight first portion and a sharp bend downstream of said first portion, said sharp bend having one or more abrupt changes in the smoothness of boundary walls, and said fuel being redirected by said sharp bend; and rotating said fuel with a rotating element within said flow pathway and upstream of said bend, said rotation element rotating the flow of said fuel to produce a substantially uniform distribution of the fuel flow after said fuel flows through said bend in said flow pathway.

18. The method of claim 17, further comprising:

injecting said fuel through a nozzle tip into a combustion chamber after said fuel flows through said rotation element and said bend.

19. The method of claim 17, wherein an even flow distribution of the flow of fuel into a combustion chamber is produced independent of a magnitude of velocity of said fuel flowing through said flow pathway.

20. The method of claim 17, wherein said fuel flowing through said flow pathway is substantially devoid of low frequency acoustic resonance at subsonic flow conditions.

21. The method of claim 17, wherein said fuel injected through said nozzle tip has a residual rotation to provide even pressure distribution across the nozzle tip to be maintained.

22. The method of claim 17, wherein pressure resistance to the flow of said fuel in a forward flow direction through said flow pathway is lower than in a reverse flow direction.

* * * * *